US010845130B2

(12) United States Patent
Lambertson

(10) Patent No.: US 10,845,130 B2
(45) Date of Patent: Nov. 24, 2020

(54) HEAT RECOVERY SYSTEM FOR COMMERCIAL KITCHEN COOKING APPLIANCES

(71) Applicant: STREIVOR INC., Livermore, CA (US)

(72) Inventor: Jeffrey S. Lambertson, Danville, CA (US)

(73) Assignee: STREIVOR, INC., Livermore, CA (US)

( * ) Notice: Subject to any disclaimer, the term of this patent is extended or adjusted under 35 U.S.C. 154(b) by 71 days.

(21) Appl. No.: 15/864,963

(22) Filed: Jan. 8, 2018

(65) Prior Publication Data

US 2018/0195808 A1 Jul. 12, 2018

Related U.S. Application Data

(60) Provisional application No. 62/444,182, filed on Jan. 9, 2017.

(51) Int. Cl.

| | |
|---|---|
| ***F28D 21/00*** | (2006.01) |
| ***F24C 15/20*** | (2006.01) |
| ***F24C 15/34*** | (2006.01) |
| ***F24C 15/18*** | (2006.01) |
| ***F24C 15/00*** | (2006.01) |

(52) U.S. Cl.

CPC ..... *F28D 21/0008* (2013.01); *F24C 15/2021* (2013.01); *F24C 15/2071* (2013.01); *F24C 15/001* (2013.01); *F24C 15/18* (2013.01); *F24C 15/20* (2013.01); *F24C 15/34* (2013.01); *F24D 2200/18* (2013.01); *F28D 21/0003* (2013.01)

(58) Field of Classification Search

CPC .. F28D 21/0003; F28D 21/0008; F24C 15/18; F24C 15/20; F24C 15/001

See application file for complete search history.

(56) References Cited

U.S. PATENT DOCUMENTS 3,194,308 A * 7/1965 Haried ..... D06F 58/20 165/165
3,827,343 A * 8/1974 Darm ..... F24C 15/2057 126/299 D (Continued)

*Primary Examiner* — Paul Alvare

(74) *Attorney, Agent, or Firm* — Kilpatrick Townsend & Stockton LLP

(57) ABSTRACT

A heat exchange system for commercial kitchen installations, having a dedicated plenum to receive combustion emissions separate from cooking emissions, where the plenum has a heat exchange structure that efficiently and directly draws heat from the combustion emissions. The plenum heat exchange structure reduces the air volume that a ventilation hood covering the kitchen appliances needs to process and filter, while concurrently obtaining heat from combustion emissions without interference from cooking emission effluents such as grease, smoke, or particulate matter. Heat drawn out of the combustion emissions can be stored in a thermal reservoir for powering other parts of the commercial kitchen or other uses. The diverted airstream from combustion emissions, once passed through the heat exchange structure, can further ventilate through an additional heat exchanger, to provide tempered air to an interior location, such as the commercial kitchen via an air supply duct in the cooking emission ventilation hood.

6 Claims, 10 Drawing Sheets

(56) References Cited

U.S. PATENT DOCUMENTS

| | | | | |
|---|---|---|---|---|
| 4,462,387 | A * | 7/1984 | Welsh | F24C 15/20 126/299 R |
| 6,394,083 | B1 | 5/2002 | Lambertson | |
| 8,728,189 | B2 | 5/2014 | Prasser | |
| 9,732,966 | B2 | 8/2017 | Lambertson | |
| 2006/0032490 | A1* | 2/2006 | Johnson | F23C 3/002 126/92 B |
| 2007/0068509 | A1* | 3/2007 | Bagwell | B08B 15/00 126/299 D |
| 2009/0264060 | A1* | 10/2009 | Livchak | B08B 15/023 454/61 |
| 2012/0055460 | A1* | 3/2012 | Lambertson | F24F 7/06 126/299 D |
| 2013/0092148 | A1* | 4/2013 | Parvin | F24C 15/20 126/299 D |
| 2015/0101589 | A1* | 4/2015 | Baumgardner | F24C 15/20 126/299 D |

* cited by examiner

HEAT RECOVERY SYSTEM FOR COMMERCIAL KITCHEN COOKING APPLIANCES

CROSS-REFERENCES TO RELATED APPLICATIONS

This application claims the benefit of priority to U.S. Provisional Application No. 62/444,182, entitled "HEAT RECOVERY SYSTEM FOR COMMERCIAL KITCHEN COOKING APPLIANCES" and filed on Jan. 9, 2017, which is hereby incorporated by reference.

TECHNICAL FIELD

The present invention relates to heat recovery systems applied with appliances that generate clean and dirty emissions, and in particular with appliances for commercial kitchen installations.

BACKGROUND

In a typical restaurant kitchen, a plurality of cooking appliances are lined up side by side in a row under a common exhaust hood. The cooking units may include, for example, ranges, griddles, fryers, and broilers. The cooking processes performed on such appliances all produce air laden with grease, smoke, fumes, moisture, heat, and other particles in varying amounts and temperatures that coalesces into a thermal plume. A hood is typically positioned above the cooking appliances to capture and contain a mixture of clean and dirty emissions that coalesce into a thermal plume, where an exhaust fan can then draw the thermal plume out of the hood, often through a grease extraction device, where it is filtered. The air rising in to the exhaust hood is often filtered. One known filtration system is disclosed in U.S. Pat. No. 6,394,083 to Lambertson, titled "ADJUSTABLE VENTILATOR CARTRIDGE FILTER", the disclosure of which is hereby incorporated by reference.

Commercial kitchen exhaust hoods manufactured to be installed in the U.S. must comply with certain codes and standards, such as the National Fire Protection Associates (NFPA) Standard 96. This standard requires that all hoods used in commercial cooking establishments that are installed over cooking appliances that create effluents other than heat and steam, such as grease, during the cooking process include grease removal devices that are individually listed in accordance with Underwriters Laboratories (UL) Standard 1046, or as components of UL 710 listed hoods. This standard requires grease removal devices to be able to prevent the spread of fire from the upstream face of the filter to an area downstream of the filter, and the filter demonstrates that four times more grease drains from the filter than the amount of grease that collects on the filter during the test. Generally, hoods that are used to vent commercial cooking appliances that produce grease and/or smoke are Type I (or "Type 1") hoods, and hoods that are used to vent only heat and water vapor (and not grease or smoke) are Type II (or "Type 2") hoods.

Traditionally, the amount of heat generated by the variety of kitchen appliances is a lost source of energy, where at most a heat exchanger remote from the kitchen (e.g. on the roof of a building) may handle the emissions from the kitchen appliances after the emissions have passed through one or more hoods and various ductwork. Preliminary efforts have been made to capture or recover some heat generated by such appliances, but not without flaws, as discussed below.

U.S. Pat. No. 8,728,189 discloses a device that is inserted into a hood that is designed to work as a filter and as a heat exchanger. Such a device is prone to several difficulties which will unavoidably hinder the ability of the device to achieve efficient or even sustainable heat recovery. For example, a substantial amount of grease will collect in and on the device, requiring repeated significant cleaning cycles. Further, given the structure and flow path of the device, the average temperature of the exhaust mass passing through the device will likely not be at a temperature sufficiently high enough to achieve a significant amount of recoverable heat. In some aspects, the exhaust mass can be considered to be the thermal plume, formed of a mixture of clean and dirty cooking appliance emissions and a significant amount of surrounding low-temperature air.

U.S. Patent App. Pub. No. 2013/0092148 discloses a hood that includes both a combustion fume outlet and a cooking fume outlet. The combustion plume outlet collects an exhaust mass that consists substantially of the burned and unburned gases existing the cooking appliance flue in a bypass chamber. A fluid heat recovery device may be installed in the bypass chamber, in which the heated mass may transfer heat to a fluid heat exchanger before exhausting into the hood, recombining with the cooking fume emissions, and then being exhausted into the atmosphere. Such a device is limited to the amount of energy that can be transferred to a fluid heat recovery device while the heated mass is in the bypass chamber, and thus only a small portion of the recoverable energy of the heated mass is recovered, while the greater amount of energy contained in the mass is exhausted by the hood into the atmosphere—none of that heated mass is available for a more efficient air-to-air heat transfer process. Moreover, the recombination of the combustion fume and cooking fume emissions leads to an overly complex fluid and gas management problem, where particulates from the cooking fume emissions can transfer into the bypass chamber to the detriment of the heat exchanger unless there is an extensive fluid control system additionally implemented to try and mitigate unwanted depositions in the bypass chamber. Even with an intermediary fluid control system between the main space of the hood and the bypass chamber, there is no method or structure that can guarantee the heat exchanger will remain separate and free from grease and smoke products, degrading the efficiency of any heat recovery and possibly risking the safety of the overall hood. Also, the recombination of the combustion chamber and the bypass chamber creates an engineering challenge and added cost and complexity in regard to complying with the code required (UL) Standard 300, the testing of Fire Extinguishing Systems for Protection of Commercial Cooking Equipment.

There remains an unmet need to provide for a heat recovery system that can efficiently and economically draw and recover heat energy from appliances, particularly from the thermal plume of kitchen cooking appliances in a commercial installation. The energy obtained, recovered from otherwise being waste air vented directly into the atmosphere, and thereby contributing to climate change, is reapplied for use as power and/or heating in a variety of other heating, ventilation, and air conditioning (HVAC) or power generating applications.

BRIEF SUMMARY

The present disclosure is directed toward efficiently recovering heat from appliances, particularly kitchen appliances that generate both combustion emissions and cooking emissions. The system of the present disclosure can manage the thermal emissions or thermal plume of such appliances so as to direct the relatively clean combustion emissions toward and into a heat recovery system without intermixing with the relatively unclean cooking emissions.

As used herein, the term "cooking emissions" generally refers to (but is not limited to) grease-laden and/or smoke-laden air generated during the cooking process. Cooking emissions can be considered as, or alternatively referred to as, "unclean", "dirty" or "polluted" emissions. Combustion emissions, generated by fire and other such heat sources, for example, burners used to cook food on or in a kitchen appliance, are considered "clean" relative to the unclean cooking emissions in the sense that the cooking emissions generally contain a meaningful amount of grease and/or smoke, or particulate matter coming off of cooking ingredients. Indeed, combustion emissions, particularly efficient natural gas combustion, can be referred to as "clean-burning". Cooking emissions can be further distinguished from combustion emissions in that cooking emissions tend to generate and have greater amounts or humidity and stronger odors than combustion emissions. Cooking emissions, due to their humidity, odor, and generally unclean character, are undesirable and often unusable for HVAC and air-to-air exchanger applications.

Exemplary embodiments of present system include a diversion heat exchange system having: one or more appliances that each generate both combustion emissions and cooking emissions, where each appliance has a combustion flue; a hood structure arranged above the one or more appliances, the hood being configured to collect and ventilate the cooking emissions; and a diversion plenum, connected to the combustion flue of each of the one or more appliances, configured to receive the combustion emissions, and further configured to draw and recover heat from the combustion emissions. In some aspects, the system can further include a ventilator arranged to draw air out of the diversion plenum. In other aspects, the diversion plenum can further include: a fluid heat exchange structure, mounted within the diversion plenum; a heat exchange coil structure, configured to direct a cooling fluid through the heat exchange coils; a fluid heat exchange input in fluid communication with the heat exchange coil structure and configured to deliver the cooling fluid to the heat exchange coil structure; a fluid heat exchange output in fluid communication with the heat exchange coil structure and configured to drain the cooling fluid from the heat exchange coil structure; and an exhaust duct coupled to the ventilator, arranged to conduct cooled combustion emissions away from the heat exchange coil structure. The hood structure can be a Type I hood or a Type II hood, further connected to an exhaust fan configured to exhaust cooking emissions. Alternatively, the system can further include: an air-to-air or air tempering heat exchanger, configured to transfer heat from the combustion emissions into air drawn from the atmosphere into the ventilator and thereby generate tempered air; and a supply plenum, in fluid communication with the ventilator, configured to deliver the tempered air proximate to the appliances. In other aspects, the system can be configured to deliver tempered air to locations distal from the appliances. In some such aspects, the air tempering heat exchanger can be located within the ventilator. In other such aspects, the air tempering heat exchanger can be located along the exhaust duct coupled to the ventilator.

Further exemplary embodiments of present system include a diversion plenum for a heat exchange system having: a plenum positioned proximate to one or more emission sources, the plenum being configured to receive combustion emissions; a fluid heat recovery structure, mounted within the plenum; a set of heat exchange coils, configured to flow a thermal fluid through the heat exchange coils a fluid heat exchange inlet and a fluid heat exchange outlet, in fluid communication with the heat exchange coils and both configured to flow the thermal fluid into, through, and out of the heat exchange coils; and an exhaust duct arranged to direct away cooled combustion emissions. In some aspects, the diversion plenum further includes a plurality of access ports configured to mechanically couple with one or more flue adaptors. The diversion plenum can further have the mechanical couplings between the diversion plenum and each flue adaptor configured to form a pathway for gaseous fluid communication. Further, each access port of the plurality of access ports in a diversion plenum can be selectively open or closed to couple with any given flue adaptors. In some aspects, the diversion plenum can also include a deflection rudder, configured to direct the flow of combustion emissions within the diversion plenum.

Other exemplary embodiments of present system include a control system for a heat exchange system, having: a controller in electronic communication with operational components of the heat exchange system; one or more combustion generating appliances, each having sensors and control circuitry in electronic communication with the controller; a ventilation hood with an integral fire suppression system, coupled with an exhaust fan having control circuitry in electronic communication with the controller; a fluid pump, in fluid communication with both a fluid storage reservoir and a fluid heat exchange structure, having control circuitry in electronic communication with the controller. In some aspects, the system can further include a ventilator, in fluid communication with a combustion exhaust chamber and an external air source, having control circuitry in electronic communication with the controller. In other aspects, the combustion exhaust chamber can further include either or both of pressure sensors and thermal sensors in electronic communication with the controller. The controller can be a non-transitory computer-readable medium configured to receive and optionally execute any or all of automated, programmed, and user-entered operational instructions. Moreover, the control system can include a remote user interface, in electronic communication with the controller, configured to display output data regarding the heat exchange system, and further configured to receive and relay input instructions to the controller to operate and control the heat exchange system. The controller of the control system can be electronic communication with either or both of pressure sensors and thermal sensors in the ventilator. Similarly, the overall system can further include an air-exchanger, and controller of the control system can be electronic communication with either or both of pressure sensors and thermal sensors in the air-exchanger. In further aspects, the heat exchange system can recover from about five hundred thousand BTU to about five million BTU of energy from the one or more combustion generating appliances.

In addition to the exemplary aspects and embodiments described above, further aspects and embodiments will become apparent by reference to the figures and by study of the following detailed description.

BRIEF DESCRIPTION OF THE DRAWINGS

Illustrative aspects of the present disclosure are described in detail below with reference to the following drawing figures. It is intended that that embodiments and figures disclosed herein are to be considered illustrative rather than restrictive.

DETAILED DESCRIPTION OF EXEMPLARY EMBODIMENTS

Figure 1A:
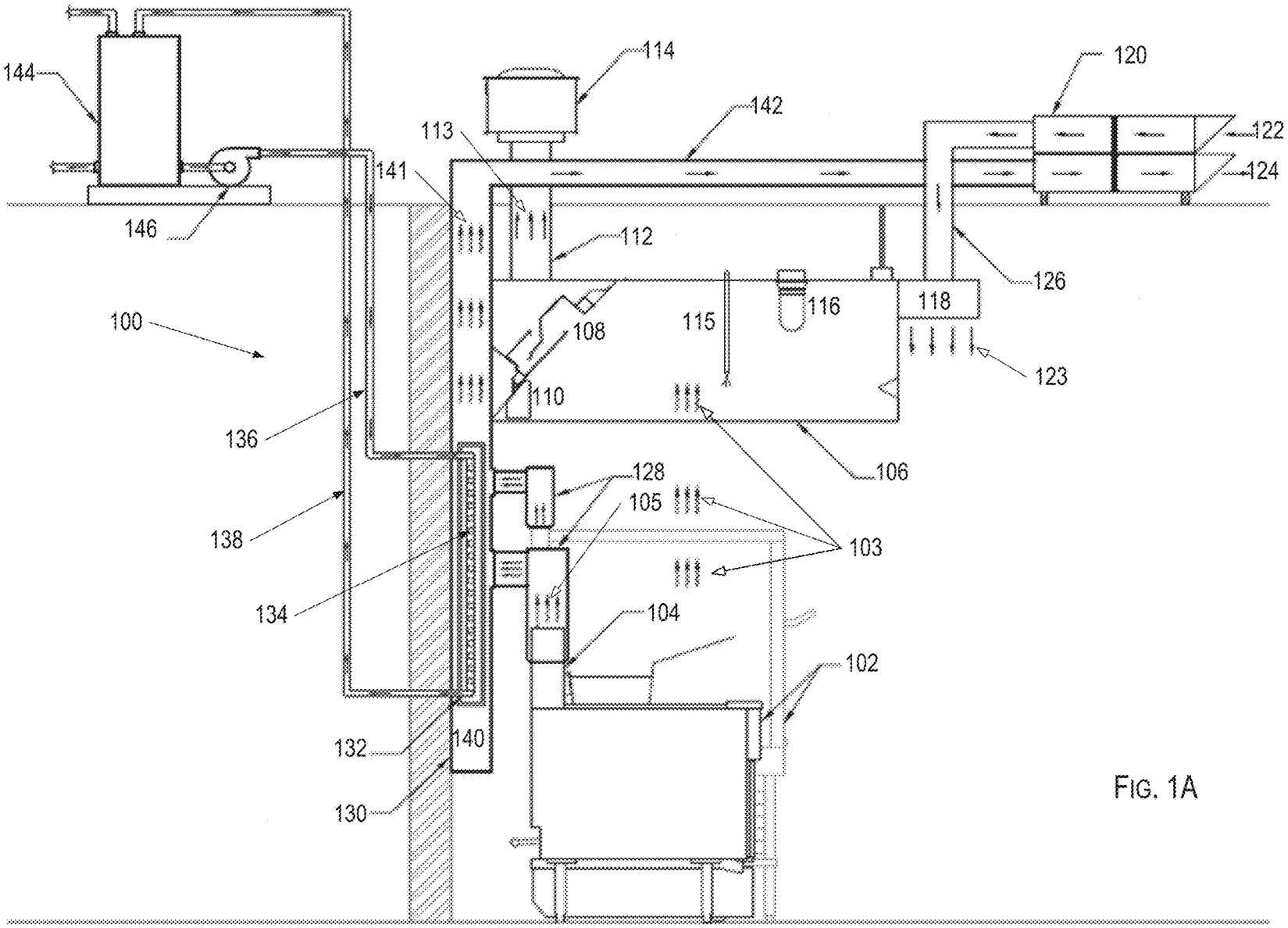
FIG. 1A is a side profile schematic representation of a heat recovery system, according to an embodiment of the present disclosure.

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

As used herein, the term "about" is used to provide flexibility to a numerical range endpoint by providing that a given value may be "above" or "below" the value. Unless otherwise specified, about modifies a given value by ±10%.

The present disclosure generally relates to a heat recovery system for commercial kitchen cooking appliance that create thermal plumes, where the thermal plumes can include both grease laden air and non-grease laden air generated during the cooking process. The heat recovery system includes a dedicated heat recovery plenum (alternatively referred to as a diversion plenum, an exhaust plenum, or a combustion exhaust chamber) that is coupled via one or more flue transition structures that directly connect to one or more appliance flues. Further, the heat recovery system includes a ventilator connected to draw the non-grease laden air out of the heat recovery plenum into a dedicated duct, which conveys the non-grease laden air to optional, further heat recovery devices. This heat recovery system is configured to be installed in combination with a Type I or Type II commercial kitchen hood, but the heat recovery system works independently of the Type I or Type II hood.

It is known that commercial kitchens often use a substantial amount of gas to heat cooking appliances before during and after the cooking process, and that a substantial amount of grease laden vapor is created during most cooking processes both of which typically require mechanical exhausting. National building and fire codes generally require that a Type I Commercial Kitchen Ventilation Hood System be installed over cooking appliances that produce grease laden vapors. The Type I hood is engineered to capture, contain, filter, and exhaust the mass of burned and unburned gases, as well as the cooking effluents such as grease and water vapor, generated during the cooking process that coalesce to form a thermal plume. The Type I hood, in addition to exhausting the thermal plume created from the cooking appliances (which can include various gases and effluents), also exhausts a volume of air from the surrounding room and environment. The air collected from the surrounding environment often makes up a large percentage of the total mass that is exhausted by the Type I hood. The entire mass drawn into the Type I hood is generally exhausted directly into the atmosphere.

More specifically, all national building, fire, and mechanical codes and standards mandate that a Type I hood system be installed over commercial cooking appliances that generate grease laden vapors during the cooking process. A typical Type I wall canopy hood requires approximately two hundred fifty cubic feet per minute of exhaust air volume for every linear foot of kitchen hood length (250 CFM/ft.). A twelve foot (12 ft.) long Type I wall canopy hood requires approximately three thousand cubic feet per minute (3,000 CFM) of exhaust air to ventilate a mixed line of cooking appliances. In such a mixed line of cooking appliances, it is typical to have as much as one hundred thirty-two inches (132") of cooking appliance linear length covered by a one hundred forty-four inch (144") hood. A typical mixed line of cooking appliances, for example, can include a thirty inch (30") two tank fryer that operates at two hundred thousand BTU (200,000 BTU), a thirty-six inch (36") griddle that operates twenty-five thousand BTU (25,000 BTU), a twenty-four inch (24") hot top that operates at thirty-five thousand BTU (35,000 BTU), and a forty-eight inch (48") combination oven that operates at ninety thousand BTU (90,0000 BTU). The total recoverable heat energy that is available in this exemplary mixed line cooking appliance scenario, when all of the cooking appliances are operating at full power, is approximately three hundred fifty thousand BTU (350,000 BTU).

The ability to take advantage of the energy produced by such kitchen appliances is readily evident. A typical roof-top mounted heated replacement air unit that is capable of providing three thousand CFM (3,000 CFM) of tempered air with a fifty-degree delta (A 50° F.; i.e. warming external air by 50° F. then providing it to an indoor room) requires roughly two hundred twenty-five thousand BTU (225,000 BTU) of energy. Thus, the recoverable heat energy from the exemplary scenario above is in the range of the total energy that would be required to provide total tempering of the replacement air that is required to keep the interior room where the hood is located in balance and at a comfortable temperature, even if the outdoor temperature is 50° F. degrees colder than the desired indoor temperature. Thus, an exemplary heat recovery system as disclosed herein that provides about 3,000 CFM of tempered air can recover about 225,000 BTU of energy. In other embodiments of the present heat recovery system, depending on the length and area of the hood and related kitchen appliances, and the volume of tempered air handled, anywhere from about ten thousand BTU (10,000 BTU) of energy to about five million BTU (5,000,000 BTU) of energy can be recovered, as well as any increment or gradient thereof or range therein (e.g., five hundred thousand BTU, one million BTU, two million BTU, three million BTU, four million BTU, about five hundred thousand BTU to about five million BTU, etc.).

There are significant cost savings and efficiencies to be obtained from the productive use of a heat exchange system as in the present disclosure. For example, in July of 2015, the average price for natural gas in the United States of America was $16.18 per 1000 cubic ft. of air volume heated. At this rate, the approximate cost of operating gas appliances is $1.62 per 100,000 BTU consumed per hour. Based on the above exemplary scenario, a commercial kitchen that operated twelve hours per day (12 hr./day) producing three hundred fifty thousand BTU per hour (350,000 BTU/hr.), that energy being recoverable due to the present invention, could recover as much as $68.04 dollars per day, which extrapolates to about $24,834.60 per year, or even greater cost savings. Moreover, all energy recovered and reused will result in a direct reduction in the amount of greenhouse gases that are released directly into the atmosphere.

The difficulties of achieving efficient and sustainable heat recovery from the exhaust mass of a Type I Hood, however, have been well documented, with two of the most difficult challenges being (1) the grease particulates and effluents that make up a portion of the exhaust mass collect on the heat recovery devices, making such devices less efficient, further necessitating a significant amount of cleaning to maintain those devices in efficient operating condition, and (2) the average temperature of the exhaust mass passing through the hood, which consists of the cooking appliance thermal plume and surrounding room air, is not hot enough to achieve a significant amount of energy transfer from the exhaust mass to traditional heat recovery devices.

A typical commercial kitchen appliance line will consist of several different types of cooking appliances. Appliances such as fryers, griddles, hot top, salamanders, cheese melters, convection ovens, and combination ovens, to name a few. The present system has an exhaust plenum that is engineered to have direct connections from a plurality of those cooking appliances to the exhaust plenum. The direct connections prohibit any of the cooking effluents from entering the diversion plenum. Primarily, the exhaust plume from the appliance burn chambers enters the diversion plenum. The ability to connect a plurality of different cooking appliances, with varied configurations, is a valuable component in obtaining the maximum recoverable heat available.

The heat recovery system of the present disclosure works independently of either a Type I or Type II hood system, although the heat recovery system can be used in combination with either or both of a Type I or Type II hood system. The present heat recovery system can facilitate one or more, or a plurality of, connections from cooking appliance burn chambers. The combustion exhaust plenum can facilitate fluid heat recovery devices inside the plenum, inside a duct connected to the plenum, or in the pathway to the ventilator. The present heat recovery system can further facilitate the delivery of a heated air mass to heat recovery ventilation units such as rotary air-to-air heat exchangers or thermal wheels, where the heated air mass can be used to directly and/or indirectly heat or preheat the supply air and/or replacement air components of the buildings ventilation or replacement air systems. In various configurations, the present heat recovery system can include any one or a combination of a parallel-flow heat exchanger, a counter-flow heat exchanger, a cross-flow heat exchanger, a distributed vapor heat exchanger, a spiral heat exchanger, or a shell-and-tube heat exchanger. In various embodiments, heat exchange can occur where the disclosed system has only fluid-based heat exchangers, only air-based heat exchangers, or a combination of fluid-based and air-based heat exchangers.

FIG. 1A is a side profile schematic representation of an exemplary diversion heat recovery system 100 as implemented in a commercial kitchen environment. Kitchen appliances 102 are arranged beneath a Type I hood 106 (alternatively referred to as a wall canopy hood), where the Type I hood 106 is positioned to collect and ventilate emissions from the kitchen appliances 102 out of the kitchen environment. Kitchen appliances 102 can include, but are not limited to, fryers, griddles, hot tops, salamanders, cheese melters, convection ovens, combination ovens, and the like. The kitchen appliances 102 use combustion to generate heat on or within the cooking apparatus—in other words, fire is used to cook food by heating metal, cooking oils, and/or other cooking media. The combustion reactions of the kitchen appliances 102 generate combustion emissions 105. The air of the combustion emissions 105 can include both combusted reactants and non-combusted components, but the combustion emissions 105 always include an amount of heat energy. Each kitchen appliance 102 has an appliance flue 104 (alternatively referred to as a combustion flue), the appliance flue 104 being an outlet structure of the kitchen appliance 102 configured for exhausting the generated combustion emissions 105. In the present heat recovery system 100, each kitchen appliance 102 further has an appliance flue adaptor 128 (alternatively referred to as a transition structure, redirection module, or the like) connected to the appliance flue 104, where each appliance flue adaptor 128 is mechanically coupled to a respective appliance flue 104 so as to form a gaseous fluid communication path for the combustion emissions 105. The connection of each appliance flue adaptor 128 over the respective appliance flue 104 is sufficiently airtight, for example, by forming a frictional seal, such that cooking emissions 103 from the cooking surfaces of the kitchen appliances 102 are excluded from entering the spaces enclosed by the appliance flue adaptor 128.

The Type I hood 106 positioned over the kitchen appliances 102 provides for a standard exhaust path for cooking emissions 103. In alternative embodiments, the hood can be a structure other than a canopy hood, so long as the hood still sufficiently meets the codes and regulations applicable to commercial kitchen installations. In other embodiments, a Type II hood can be positioned over the kitchen appliances 102. The Type I hood 106 includes a filter structure 108 configured to inhibit flames from passing through the hood into the duct and remove effluents such as smoke and grease from the cooking emissions 103 before exhausting the secondary cooking emissions 113 into the exterior atmosphere. In some aspects, the filter structure 108 can be a two-stage filter such as described in U.S. Pat. No. 9,732,966 to Lambertson, titled "MULTI-STAGE HOOD FILTER SYSTEM", the disclosure of which is herein incorporated by reference. The filter structure 108 can be connected to an enclosed grease collection container 110 (alternatively referred to as a trap) also located within the Type I hood 106. Type I hood can include a light fixture 116 positioned to illuminate a cooking area. Further, the Type I hood 106 includes a fire suppression system 115 positioned and configured within the canopy of the Type I hood 106 to prevent unintended or uncontrolled grease fires and the like on or within the kitchen appliances 102.

A cooking emission exhaust duct 112 is connected to a cooking emission exhaust fan 114, where the cooking emission exhaust fan 114 draws secondary cooking emissions 113, through the cooking emission exhaust duct 112, away from the Type I hood 106. Secondary cooking emissions 113 can be understood as cooking emissions 103 after passing through filter structure 108, having a fraction of effluents removed from the overall cooking emission flow, thereby being relatively cleaner than cooking emissions 103, but still being substantively unclean (at least for heat exchange/recovery applications). Typically, the cooking emission exhaust fan 114 is located on the roof or other exterior surface of a building in which the kitchen appliances 102 are located. More specifically, as the cooking emissions 103 rise up from the kitchen appliances 102 into the plenum of the Type I hood 106, the draw generated by the cooking emission exhaust fan 114 pulls the cooking emissions 103 through the filter structure 108. After passing through the filter structure, the air moved out of the Type I hood 106 plenum is secondary cooking emissions 113. In addition to the cooking emissions 103, ambient air from the interior environment (i.e. the kitchen) is also drawn into the Type I hood plenum 106 and mixes with the cooking emissions 103 as the air passes through the filter structure 108 and out of the building through the cooking emission exhaust duct 112 and cooking emission exhaust fan 114.

Notably, the combustion emissions 105 generated by the kitchen appliances 102 do not mix with the cooking emissions 103, and moreover, the combustion emissions 105 do not enter the plenum of the Type I hood 106. Thus, the load on the filter structure 108 and on the cooking emission exhaust fan 114 is reduced, in that with the heat recovery system 100, the overall volume of air that needs to be moved and exhausted from the kitchen appliances 102 is less than a standard installation because the combustion emissions 105 are redirected and diverted away from the Type I hood 106. The reduced load on the filter structure 108 and on the cooking emission exhaust fan 114 and other parts of the Type I hood 106 can proportionally reduce the wear on these components, and thereby reduce the frequency of necessary maintenance and/or replacement of related parts. In other words, the reduced air volume significantly reduces the amount of air that needs to be pulled out of the building and then replaced, resulting in smaller ducts, smaller exhaust and supply fans, a quieter work environment and reduced energy usage.

In the present diversion heat recovery system 100, the combustion emissions 105 from a given kitchen appliance 102 are directed through the appliance flue adaptor 128 toward a diversion plenum 130 (alternatively referred to as a redirection chamber, a heat exchange space, a secondary plenum, or the like). The diversion plenum 130 can have a plurality of ports configured to mechanically couple with one or more appliance flue adaptors 128, forming gaseous fluid communication paths from one or more kitchen appliances 102, through the one or more appliance flue adaptors 128, into the diversion plenum 130. The plurality of ports in the diversion plenum 130 can have a variety of shapes and can be positioned in a variety of locations, allowing for a flexible and modular connection scheme to a wide selection of kitchen appliances 102 and appliance flue adaptors 128. In other words, any given installation of the present diversion heat recovery system 100

The diversion plenum 130 can be connected to kitchen appliances 102 in a variety of installation configurations. Kitchen appliances 102 can be arranged, for example, under a wall-mounted canopy, a single-island canopy, a double-island canopy, a back shelf exhaust, an eyebrow exhaust, a pass-over exhaust, or the like. A diversion plenum 130 can be positioned proximate to a plurality or set of kitchen appliances 102 in any such arrangement, in a wall behind kitchen appliances 102, within a structure behind or to the side of a single-island arrangement of kitchen appliances 102, in between two rows of kitchen appliances 102 in a double-island arrangement, and so on. In some aspects, such as that of a double-island canopy, two diversion plenums 130 can be positioned back-to-back behind either line of kitchen appliances 102.

The diversion plenum 130 includes a fluid heat exchange structure 132 positioned within the diversion plenum 130, mounted or suspended in a location within the diversion plenum 130 to receive the heat from the combustion emissions 105 being directed into the diversion plenum from the one or more flue adaptors 128. The diversion plenum 130 can be constructed from a variety of materials that are thermally conductive and can also support further components of the fluid heat exchange structure 132. The fluid heat exchange structure 132 can include a set of fluid exchange coils 134 positioned or mounted within the fluid heat exchange structure 132, as well as a fluid exchange input 136 (alternatively referred to as a fluid exchange inlet) and a fluid exchange output 138 (alternatively referred to as a fluid exchange outlet). The fluid exchange input 136 directs a fluid (e.g. water; alternatively referred to as a "thermal fluid" or a "heat recovery fluid") into the fluid exchange coils 134, where heat from the combustion emissions 105 transfers into the fluid exchange coils 134 as the fluid passes through the fluid heat exchange structure 132. The fluid, having had its temperature raised due to the heat of the combustion emissions 105, exits the fluid heat exchange structure 132 via the fluid exchange output 138.

The cooling fluid directed toward and drawn away from the diversion plenum and fluid heat exchange structure 132 can be part of a control loop. The fluid can be held in a reservoir, a thermal fluid storage tank 144, where the fluid can further be used for additional heat exchange processes, or for other applications, (e.g. as hot water used elsewhere in the building). A fluid exchange pump 146 can be in fluid communication with the fluid exchange input 136, the fluid exchange coils 134, the fluid exchange output 138, and the thermal fluid storage tank 144, driving the cooling fluid through the fluid heat exchange structure 132.

The diversion plenum 130 can further include a buffer region 140, generally located underneath the fluid heat exchange structure 132. The buffer region 140 provides for a space where any excess plume from the combustion emissions 105 can collect, which helps mitigate against overheating the fluid exchange coils 134. The buffer region 140 can be used in combination with other pressure releases connected to the fluid exchange coils 134 to prevent damage to the overall system. The length of the fluid exchange coils 134 can be selected to accommodate the expected amount of heat to be received from the combustion emissions 105 and the number of kitchen appliances 102 connected to the diversion plenum 130. The heat recovered from this system can be repurposed for other heating applications connected or proximate to the a diversion heat recovery system 100.

The diversion plenum 130 is attached to a diversion duct system 142 that connects to a ventilator 120. The ventilator 120 can be a relatively low-horsepower exhaust ventilator, with an electric motor to ventilate the diversion plenum 130 and the diversion duct system 142. In some aspects, the ventilator 120 can be a heat exchanger located remote to the kitchen and externally (e.g. on the roof of a building). While the ventilator 120 may require a motor or pump not needed in other traditional ventilation systems, the power used to ventilate the diversion plenum 130 and diversion duct system 142 will be offset by the lower amount of cooking emissions 103/secondary cooking emissions 113 that will need to be exhausted from the Type I hood 106.

The ventilator 120 creates a negative pressure in the diversion heat recovery system 100, drawing an intermediary airstream 141 out of the diversion plenum 130 into the diversion duct system 142 and into the ventilator 120. The negative pressure draw can be set to be strong enough to draw emissions into the diversion plenum 130 without adversely affecting the burners within the combustion chambers of the various kitchen appliances 102 The intermediary airstream 141 can be understood to be the airstream of the combustion emissions 105 after having some heat extracted through the fluid heat exchange structure 132, and can be alternatively referred to as cooled combustion emissions. Where the ventilator 120 is a heat recovery ventilation device, the ventilator input airstream 122 (generally composed of atmosphere external to the building in which the kitchen is located) and the ventilator output airstream 124 (primarily composed of the intermediary airstream 141, where the intermediary airstream 141 is cooler than the combustion emissions 105 but still generally warmer than external atmosphere) can have a temperature difference such that the ventilator input airstream 122 is tempered as it is routed into a tempered air supply duct 126.

In alternative implementations, a heat recovery system can operate using direct venting, without a powered ventilator putting negative pressure through the system to draw out an airstream, but rather allowing the positive pressure of heated gases to pass the airstream through and exit the system.

The ventilator input airstream 122, in many embodiments being tempered, passes through the tempered air supply duct 126 and into a supply plenum 118 that is a part of or connected to a hood, such as the Type I hood 106 shown. The supply air 123 ventilates the kitchen, providing fresh air, and in cases where the ventilator input airstream 122 is tempered by the intermediary airstream 141 passing through the ventilator 120, the supply air 123 can in part warm or maintain the internal temperature of the kitchen.

The diversion heat recovery system 100 does not directly connect the structure of the diversion plenum 130 with the Type I hood 106 plenum—in other words, there is no bypass region or recombination of air or fumes from the combustion emissions 105 and the cooking emissions 103. This separation of the combustion emissions 105 from the cooking emissions 103 allows for heat exchange within the diversion plenum 130 to be free of particulate matter, grease, and smoke that might otherwise impede, degrade, or break the function of the fluid heat exchange structure 132 and the overall diversion heat recovery system 100. Accordingly, there is no need within the diversion plenum 130 for filters or filter structures, for grease traps, dampers, or transition regions between mixed-air inlets, or the inclusion of a UL 300 fire extinguishing system, an alternative fire suppression system, or the like.

Moreover, due to the separated and dedicated structure of the diversion heat recovery system 100, the diversion plenum 130 can be considered to be an example of a "non-loading" structure, in that the grease does not enter the diversion plenum 130 under normal and proper operating conditions. Therefore, if a fire enters the diversion plenum 130, there will be no grease deposited inside of the diversion plenum 130 to serve as fuel. Indeed, the use of the diversion plenum 130 as part of the diversion heat recovery system 100 both reduces load on the Type I hood 106 and uses clean combustion emissions 105 for heat recapture. A typical Type I hood used alone, as seen in traditional commercial kitchens, is simply, structurally, incapable of having the efficiencies of the disclosed diversion heat recovery system 100 with a diversion plenum 130. Furthermore, it can be appreciated that the combination of heat-controlling and heat-directing elements of the diversion heat recovery system 100 accomplishes far more functionality than any known Type II hood.

Figure 1B:
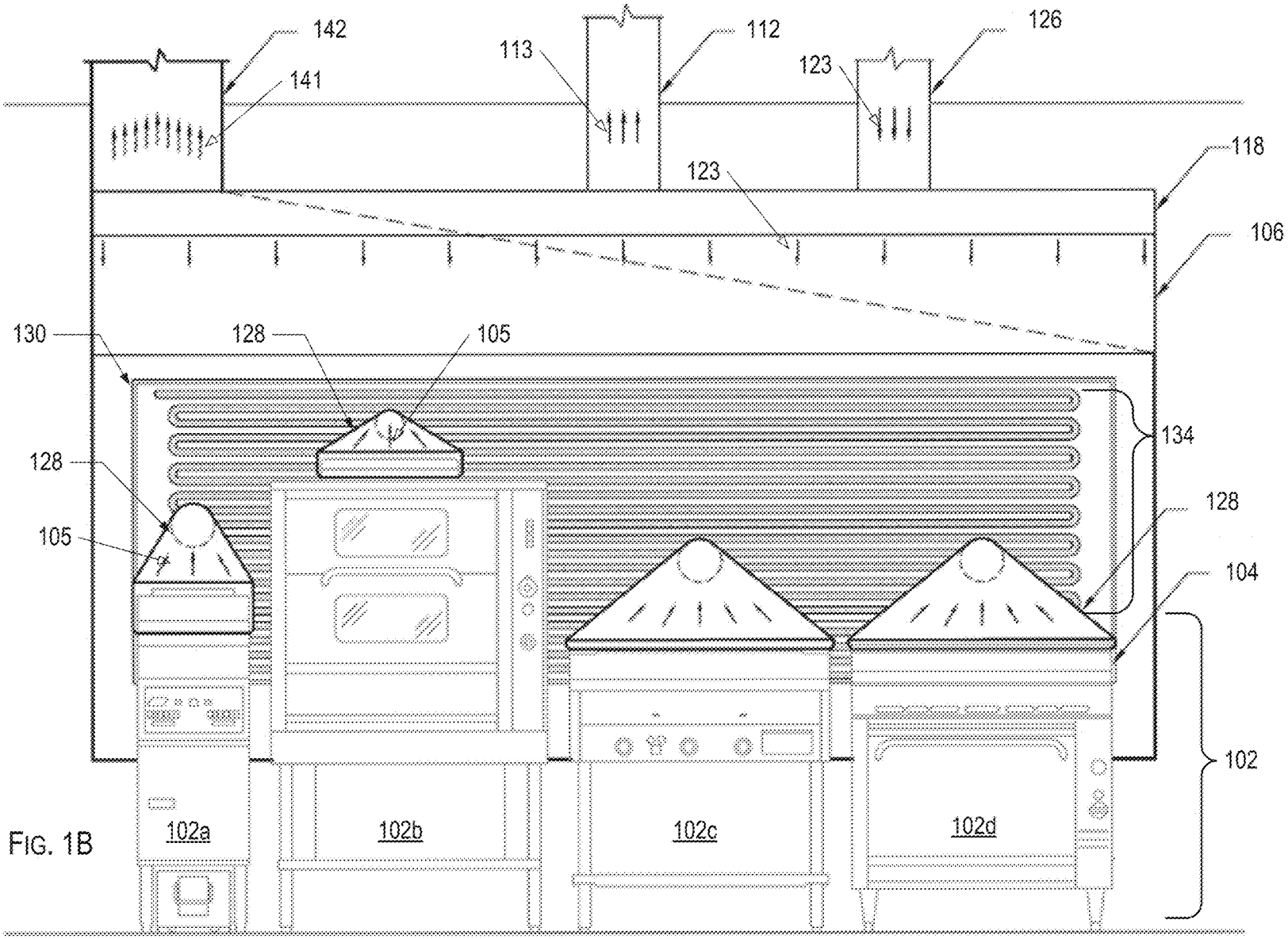
FIG. 1B is a front profile schematic representation of the heat recovery system as shown in FIG. 1A, according to aspects of the present disclosure.

FIG. 1B is a front profile schematic representation of the diversion heat recovery system 100 as shown in FIG. 1A. More particularly, the Type I hood 106 is shown above the kitchen appliances 102, covering a width greater than the line of kitchen appliances 102 alone. Secondary cooking emissions 113 are shown passing out through cooking emission exhaust duct 112, after being filtered in the Type I hood 106. The supply plenum 118 is further shown, directing an even distribution of supply air 123 over and in front of the kitchen appliances 102, drawn through the tempered air supply duct 126.

Shown in further detail in FIG. 1B is the variable and modular arrangement possible with kitchen appliances 102 connected to the diversion plenum 130 and the fluid exchange coils 134 therein. Each of the four illustrated kitchen appliances 102, individually labeled as 102*a*, 102*b*, 102*c*, and 102*d*, have a flue adaptor 128 connected to the respective appliance flue 104. The access ports to the diversion plenum 130 for the flue adaptors 128 are capable of accommodating each of the kitchen appliances 102*a*, 102*b*, 102*c*, and 102*d*, despite the difference in kitchen appliance height, size, flue aperture size, and location along the kitchen appliance 102 line. Specifically, first kitchen appliance 102*a* and second kitchen appliance 102*b* have corresponding flue adaptors 128 that are at different heights, and moreover, the access port aperture for the flue adaptor 128 connected to second kitchen appliance 102*b* is smaller than the access port aperture for the flue adaptor 128 connected to first kitchen appliance 102*a*. Similarly, third kitchen appliance 102*c* has a different height and access port aperture size as compared to both first kitchen appliance 102*a* and second kitchen appliance 102*b*. Conversely, third kitchen appliance 102*c* and fourth kitchen appliance 102*d*, while being different kitchen appliances, have comparable and effectively identical flue adaptors 128 and correspondence access port aperture sizes to connect with the diversion plenum 130. The combustion emissions of the intermediary airstream 141 are further shown, passing out from the diversion plenum 130 through the diversion duct system 142, to an external environment or, optionally, a further duct or HVAC system.

It can be understood that a kitchen appliance 102 line can be longer or shorter than the exemplary embodiment shown herein, with a correspondingly long hood 106 covering the line. Moreover, it can be understood that the flexibility in construction and design of a diversion heat recovery system 100, and the diversion plenum 130 specifically, can be individualized for any given installation, adapted for the number and/or type of kitchen appliances 102 that are part of the kitchen appliance 102 line.

Figure 1C:
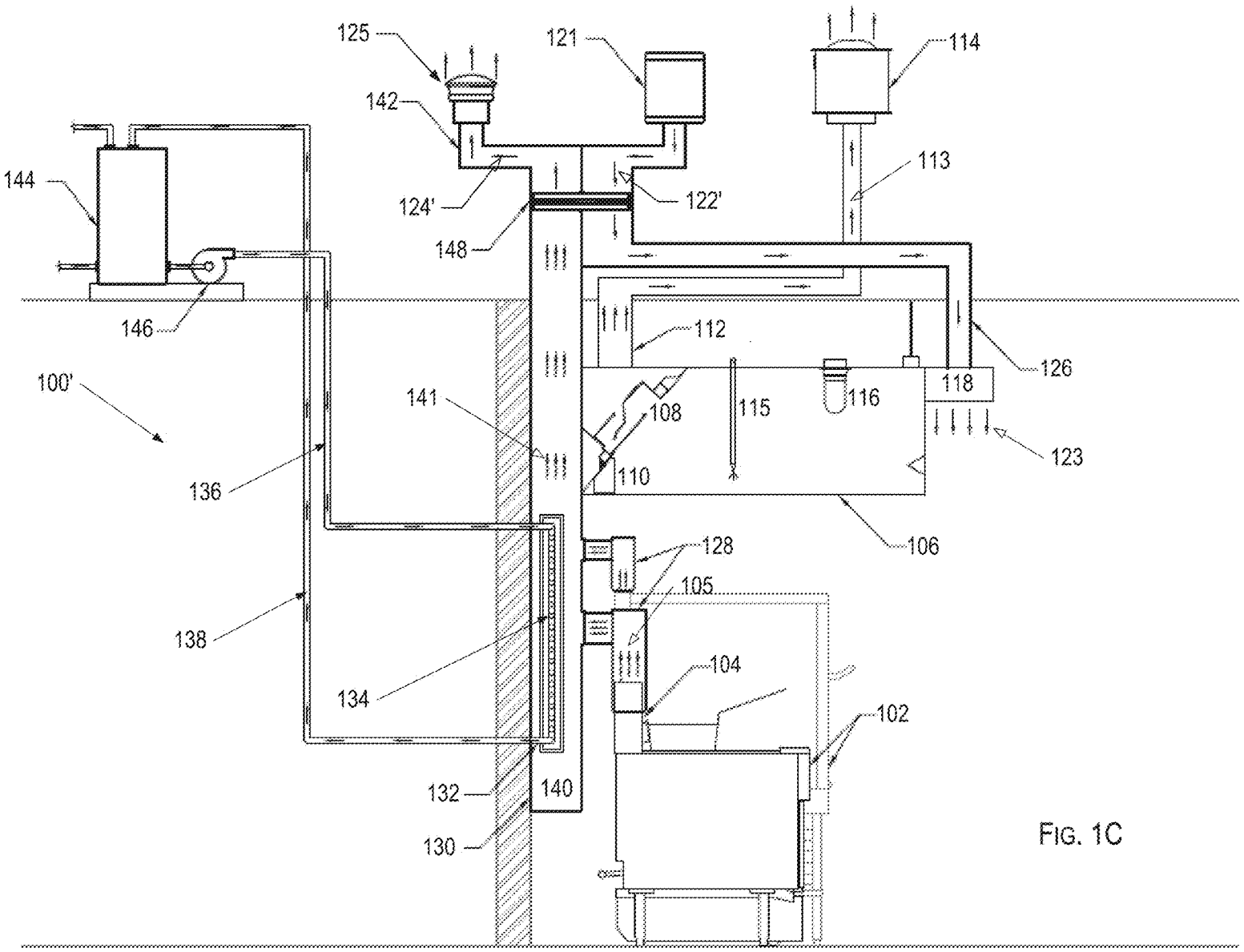
FIG. 1C is a side profile schematic representation of a heat recovery system, according to an alternative embodiment of the present disclosure.

FIG. 1C is a side profile schematic representation of an alternative exemplary diversion heat recovery system 100' as implemented in a commercial kitchen environment. In many respects, the diversion heat recovery system 100' is similar to the implementation as shown in FIG. 1A—kitchen appliances 102 are generally covered by a Type I hood 106 while combustion emissions 105 from burners are routed through appliance flue adaptors 128 to a diversion plenum 130 having a fluid heat exchange structure 132. In the implementation of diversion heat recovery system 100', however, in addition to having a fluid heat exchange structure 132, the diversion heat recovery system 100' shown in FIG. 1C further includes an air-exchanger 148 (alternatively referred to as an "air tempering heat exchanger", a "heat recovery ventilator", a "heat exchanger", or an "air-to-air exchanger"), located in the air flow path of both tempered air supply duct 126 and diversion duct system 142. In some specific embodiments, the air-exchanger 148 can be a heat recovery wheel. As shown, a combustion emission exhaust fan 125 draws the intermediary airstream 141/output airstream 124' through the diversion duct system 142 and out into the environment, while an environmental intake fan 121 can draw in air from the surrounding environment as an input airstream 122' into the tempered air supply duct 126. The air-exchanger 148 can further recover heat generated from the of kitchen appliances 102, where the intermediary airstream 141 carries a degree of residual heat after passing through the fluid heat exchange structure 132, that residual heat can be exchanged from the intermediary airstream 141/output airstream 124' to the input airstream 122', thereby tempering the input airstream 122'.

Figure 1D:
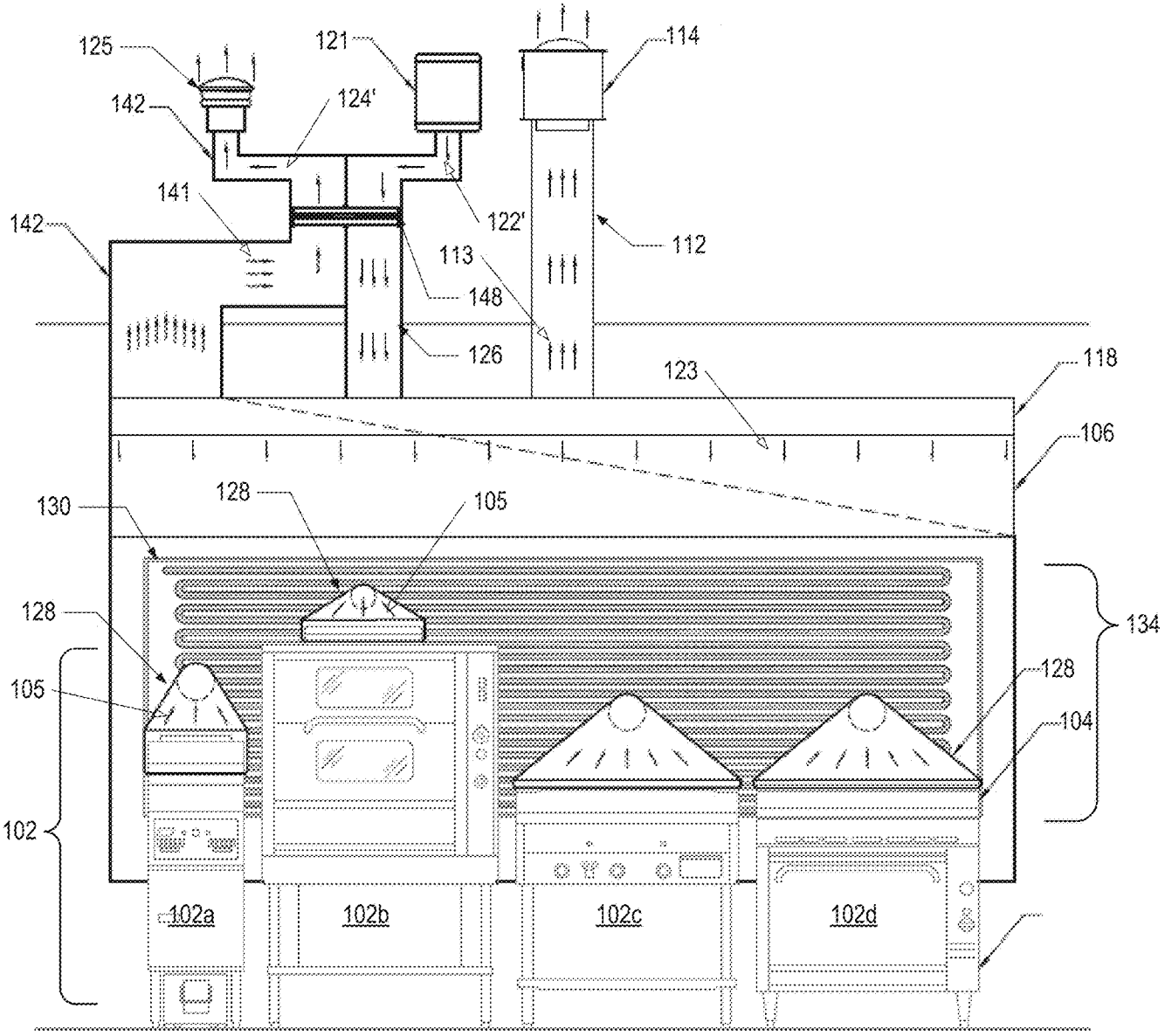
FIG. 1D is a front profile schematic representation of the heat recovery system as shown in FIG. 1C, according to aspects of the present disclosure.

FIG. 1D is a front profile schematic representation of the diversion heat recovery system 100' as shown in FIG. 1C. Secondary cooking emissions 113 are shown passing out through cooking emission exhaust duct 112, drawn by cooking emission exhaust fan 114, after being filtered in the Type I hood 106. The supply plenum 118 is further shown, directing an even distribution of supply air 123 over and in front of the kitchen appliances 102, drawn through the tempered air supply duct 126. The variable, flexible, and modular arrangement possible with kitchen appliances 102 connected to the diversion plenum 130 and the fluid exchange coils 134 is also shown, with each individual kitchen appliance 102*a*, 102*b*, 102*c*, and 102*d*, having a flue adaptor 128 connected to the respective appliance flue 104. The combustion emissions of the intermediary airstream 141 are further shown, passing out from the diversion plenum 130 through the diversion duct system 142, past air-exchanger 148, leaving the system as output airstream 124'. Similarly, environmental intake fan 121 draws in input airstream 122', pushing input airstream 122' past air-exchanger 148 through tempered air supply duct 126. Heat transfer can occur from intermediary airstream 141/output airstream 124' to input airstream 122' via air-exchanger 148. Air-exchanger 148 can be connected to other components and thermally conductive structures, to further redirect heat recovered from this system to be repurposed for other heating applications connected or proximate to the a diversion heat recovery system 100'.

Figure 1E:
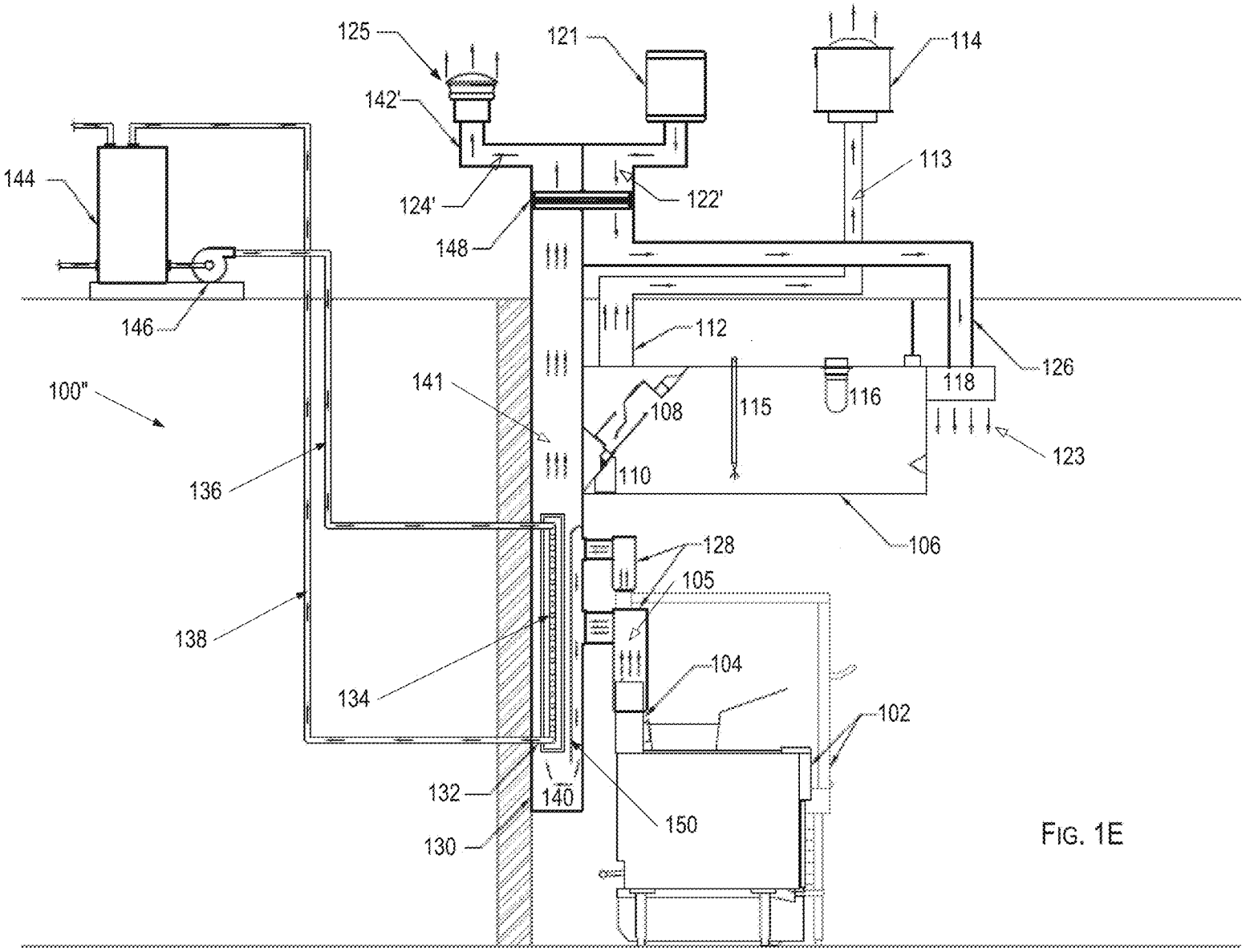
FIG. 1E is a side profile schematic representation of a heat recovery system, according to further aspects of an alternative embodiment of the present disclosure.

FIG. 1E is a side profile schematic representation of further aspects of an exemplary diversion heat recovery system 100", expanding on the implementation shown in FIG. 1C. In particular, the diversion plenum 130 further includes a deflection rudder 150 that is positioned and shaped to direct combustion emissions 105 received from one or more flue adaptors 128 downward into the buffer region 140 of the diversion plenum 130. From the buffer region 140, the combustion emissions 105 can rise upward and pass through the entirety of the fluid heat exchange structure 132. Accordingly, the inclusion of a deflection rudder 150 within the space of the diversion plenum 130 can help to ensure that the combustion emissions 105 pass through as much surface area of the fluid exchange coils 134 as possible, maximizing the heat exchange of the fluid heat exchange structure 132.

Figure 1F:
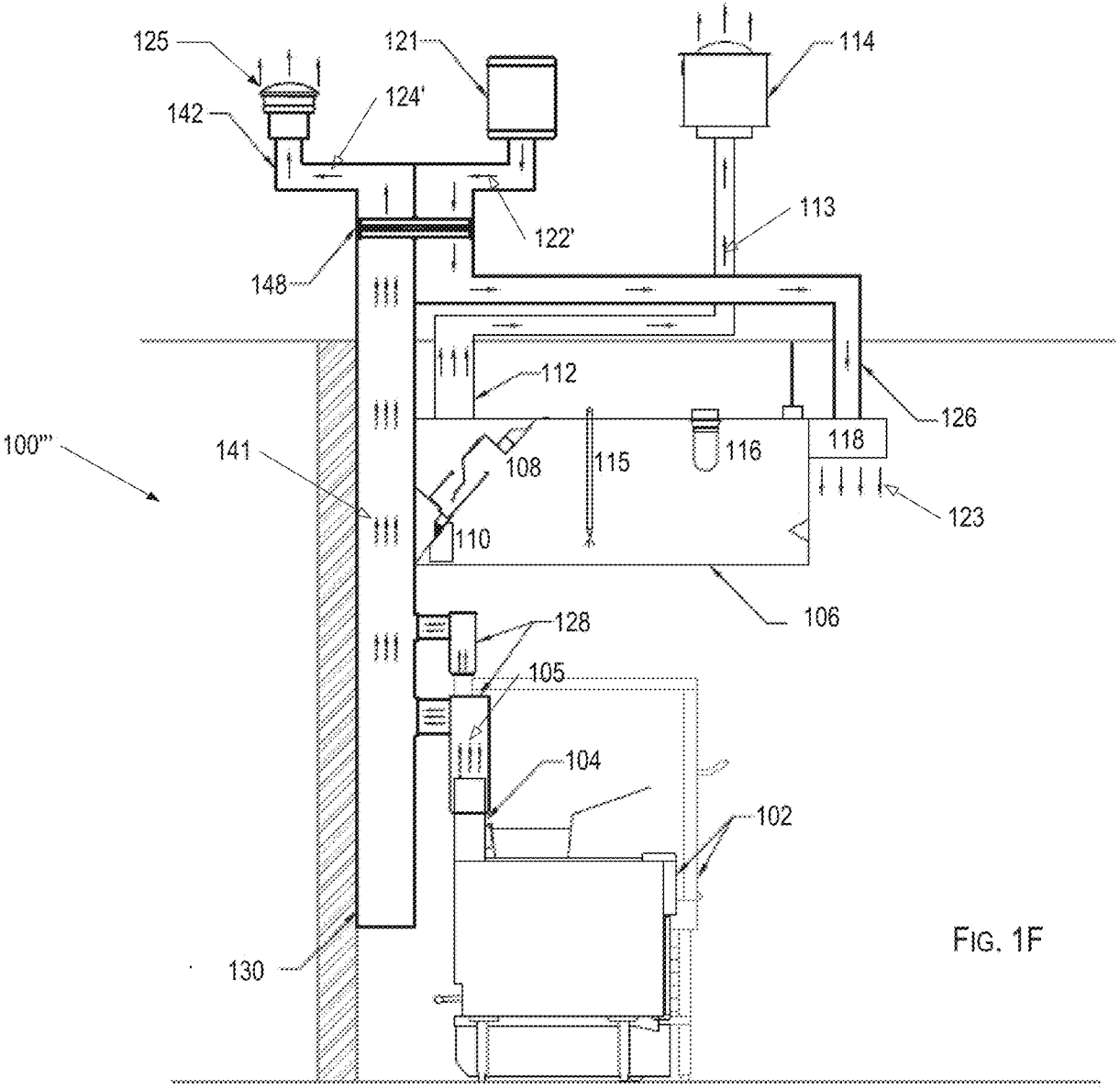
FIG. 1F is a side profile schematic representation of a heat recovery system, according to a further alternative embodiment of the present disclosure.

FIG. 1F is a side profile schematic representation of a further alternative exemplary diversion heat recovery system 100'" as implemented in a commercial kitchen environment. In many respects, the diversion heat recovery system 100' is similar to the implementation as shown in FIG. 1C—kitchen appliances 102 are generally covered by a Type I hood 106 while combustion emissions 105 from burners are routed through appliance flue adaptors 128 to a diversion plenum 130, further passing emissions through an air-exchanger 148. However, diversion heat recovery system 100'" does not include a fluid exchange structure. Rather, in the diversion heat recovery system 100'" as shown in FIG. 1F, the heat exchange occurs primarily at the air-exchanger 148. An installation of a system such as diversion heat recovery system 100'", without a fluid heat exchange structure, can be necessary given structural limitations of a particular industrial kitchen, more appropriate for a specific set of kitchen appliances 102 to be used in a specific location, and/or more efficient or cost effective for a given structure. Air-exchanger 148 can be connected to other components and thermally conductive structures, to further redirect heat recovered from this system to be repurposed for other heating applications connected or proximate to the a diversion heat recovery system 100'".

Figure 1G:
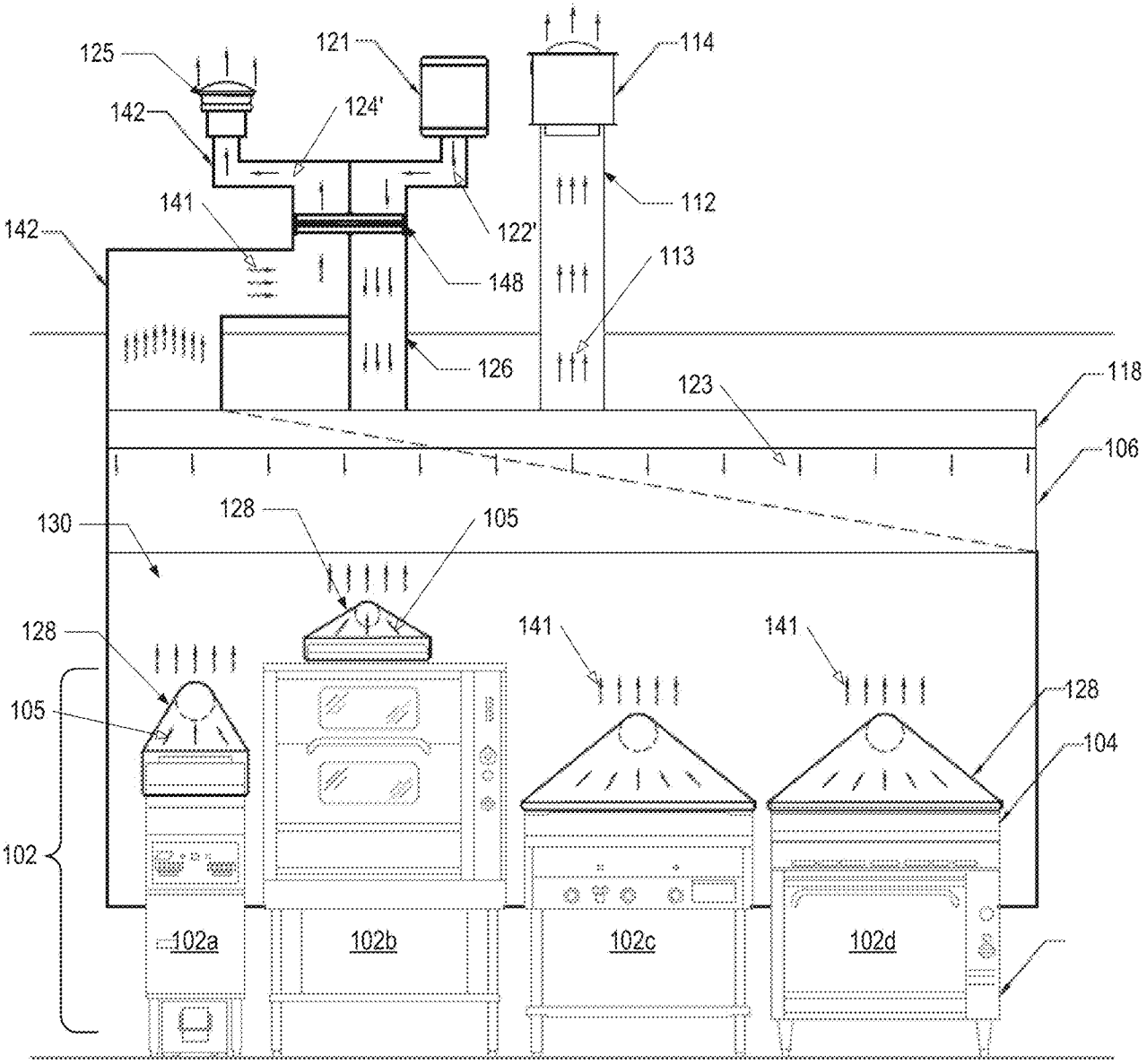
FIG. 1G is a front profile schematic representation of the heat recovery system as shown in FIG. 1F, according to a further alternative embodiment of the present disclosure.

FIG. 1G is a front profile schematic representation of the diversion heat recovery system 100'" as shown in FIG. 1F. Secondary cooking emissions 113 are shown passing out through cooking emission exhaust duct 112, drawn by cooking emission exhaust fan 114, after being filtered in the Type I hood 106. The supply plenum 118 is further shown, directing an even distribution of supply air 123 over the kitchen appliances 102, drawn through the tempered air supply duct 126. The variable, flexible, and modular arrangement possible with kitchen appliances 102 connected to the diversion plenum 130 is also shown, with each individual kitchen appliance 102*a*, 102*b*, 102*c*, and 102*d*, having a flue adaptor 128 connected to the respective appliance flue 104. The combustion emissions of the intermediary airstream 141 are further shown, passing out from the diversion plenum 130 through the diversion duct system 142, past air-exchanger 148, leaving the system as output airstream 124'. Similarly, environmental intake fan 121 draws in input airstream 122', pushing input airstream 122' past air-exchanger 148 through tempered air supply duct 126. Heat transfer can occur from intermediary airstream 141/output airstream 124' to input airstream 122' via air-exchanger 148. Air-exchanger 148 can be connected to other components and thermally conductive structures, to further redirect heat recovered from this system to be repurposed for other heating applications connected or proximate to the diversion heat recovery system 100'.

It can be appreciated, particularly in consideration of the air-exchangers 148 seen in FIGS. 1C, 1D, and 1F, that heat exchangers of the disclosed system do not have to be particularly proximate to the heat generating sources (e.g. combustion kitchen appliances), but rather only that the operative heat exchangers are in the thermal or fluid pathway of the relevant heat source. Accordingly, any air-based or fluid-based heat exchanger can be located relatively remote from the heat generating sources, for example, up on a roof of a building or on the side of a building, in which the heat generating sources are located.

Moreover, while heat recovery systems considered herein can return tempered air back to locations proximate to the kitchen appliances that are the source of the heat recovered, such tempered air can be directed to other parts of a building or other locations distal from the kitchen appliances via ductwork. For example, tempered air of the disclosed heat recovery system can be directed to rooms or hallways in a building other than the kitchen in which appliances generate the combustion emissions and heat. In another example, tempered air of the disclosed heat recovery system can be directed to buildings adjacent or relatively close to a building that has kitchen appliances generating the combustion emissions and heat. Further implementations of the present heat recovery system can direct tempered air to a combination of locations, both proximate and distal from kitchen appliances generating the combustion emissions and heat.

It can also be appreciated that the appliance flue adaptors 128 are not analogous to Type II hoods. In contrast with Type II hoods as understood in the industry, the appliance flue adaptors 128 of the present disclosure do not intake all or even a general sampling of effluents in a surrounding environment or any unclean cooking emissions. Whereas a Type II hood is configured to collect ambient air and intended to collect heat and steam (e.g., from a pasta cooker), the appliance flue adaptors 128 as disclosed herein are focused and limited to collecting combustion emissions 105 directly from kitchen appliances 102, and are not configured or intended to collect ambient air merely in the proximity of such kitchen appliances 102.

Figure 2A:
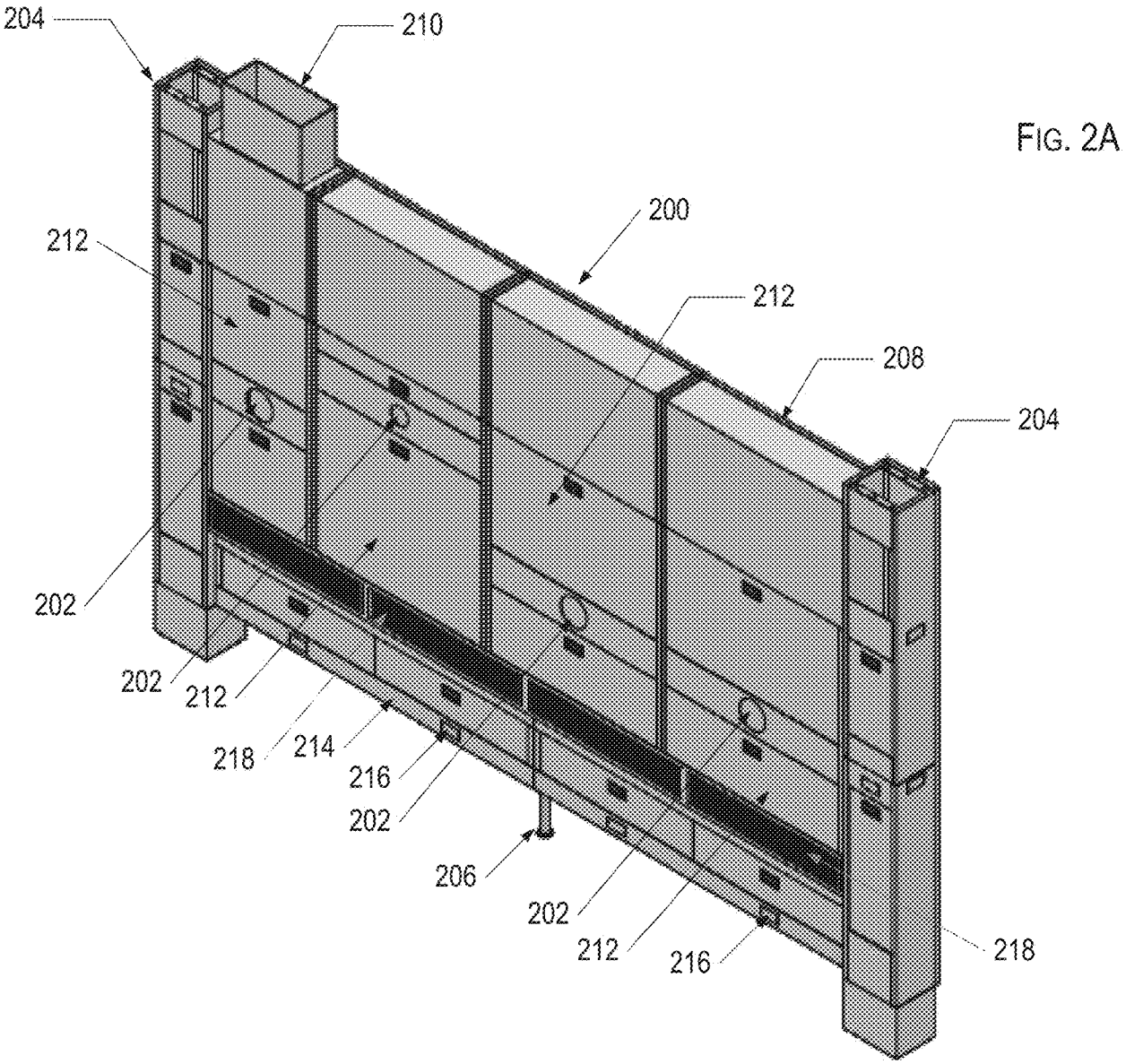
FIG. 2A is a schematic representation of a diversion plenum having access ports, according to aspects of the present disclosure.

FIG. 2A is a schematic representation of a diversion plenum 200 structure having a plurality of access ports 202. The access ports 202 are positioned within the front of the diversion plenum 200, where the front of the plenum is defined as the side of the diversion plenum 200 configured to face toward appliances of an installation (e.g. kitchen appliances of an industrial kitchen). The diversion plenum 200 structure can be structurally supported by utility verticals 204 on either lateral side or end of the diversion plenum 200, as well as by at least one support leg 206 underneath the diversion plenum 200. The utility verticals 204 can further provide access to or act as a housing for electrical wiring and connections, as well as gas or fluid plumbing. The diversion plenum 200 can further have an insulated panel 208 on the back of the plenum, the back of the plenum being the side of the diversion plenum 200 configured to be distal from the appliances of an installation. This configuration allows panels in the diversion plenum 200 to be installed directly up against building materials (e.g. walls or utility access ports), which can be combustible, non-combustible, or partially combustible materials. A plenum exhaust port 210 (seen as diversion duct system 142 above) extends upward out of the top of the diversion plenum 200 and provides for an exhaust of non-grease laden air to exit the diversion plenum 200. The plenum exhaust port 210 can lead to an external outlet, and/or to a heat recovery unit or device (e.g. a fluid heat exchanger, an air-exchanger, etc.).

Shown further are removable doors 212 in the front of the diversion plenum 200, which can be positioned both above and/or below the access ports 202. The removable doors 212 provide for openings to the interior of the diversion plenum 200 to allow for an operator to reach into the diversion plenum 200 and inspect, clean, repair, modify, or change components, sensors, and/or structures within the diversion plenum 200, (e.g. fluid exchange coils, a diversion rudder, ducts, etc.). Structurally supporting the underside of diversion plenum 200 is a utility horizontal 214, spanning the width of the diversion plenum 200 and mechanically secured to the utility verticals 204. The utility horizontal 214 can further provide access to or act as a housing for electrical wiring and connections, as well as gas or fluid plumbing. Junction boxes 216 can be positioned within and along the utility horizontal 214, providing locations for electrical connections, such as outlets for kitchen appliances proximate to the diversion plenum 200. Perforated panels 218 can also be positioned on the front of the diversion plenum, although not typically providing for fluid communication to the interior space of the diversion plenum in which combustion gasses are held and/or in which heat exchange is performed. Rather, the perforated panels 218 can provide for ventilation and cooling of components held within the utility horizontal 214 and/or the utility verticals 204, and can provide for a replacement air inlet to supply the negative pressure created by diversion plenum 200 ventilators.

The access ports 202 in the face or front of the diversion plenum 200 are illustrated as in variable positions and as having variable sizes. The access ports 202 optionally being at different locations along the height of the diversion plenum 200 provides for access points to connect with flue adaptors on kitchen appliances of varying heights. Further, the access ports 202 having optionally different sized apertures provides for the ability of the access ports 202 to accept and connect with flue adaptors of varying sizes. The access ports 202 are shown having circular apertures, but in various alternative aspects, the access ports 202 can have access ports of other shapes (e.g. square, rectangular, hexagonal, octagonal, oblong, triangular, etc.) and of larger or smaller relative sizes, thereby allowing for flexibility when connecting the diversion plenum 202 to any given arrangement or configuration of flue adaptors and/or kitchen appliances in a commercial installation.

In some aspects, the construction of access ports 202 to the diversion plenum 200 can be a pre-arranged orientation or configuration of a plurality of access ports 202. In other aspects, the construction of access ports 202 to the diversion plenum 200 can be custom arrangement of a plurality of access ports 202 built or cut into the diversion plenum 200 for a given commercial kitchen installation. A custom installation of a diversion plenum 200 can be done for a new kitchen installation or for the retrofitting of an existing kitchen. Moreover, in some implementations, the straightforward connection of kitchen appliances to a fluid heat recovery structure in the diversion plenum 200 can avoid the spiderweb-like complexity of ductwork otherwise required in most typical heat exchanger systems traditionally applied with commercial appliances.

In alternative embodiments, the access ports 202 can be designed in a modular fashion, able to be rearranged on a surface of the diversion plenum 200 such that flue adaptors (or other alternative airflow control structure) can be connected and disconnected from the access ports 202 depending on the particular configuration of connected appliances. In such implementations, each access port not connected to a flue adaptors (or other alternative airflow control structure) can be closed and sealed to maintain differential pressure within the diversion plenum 200.

Figure 2B:
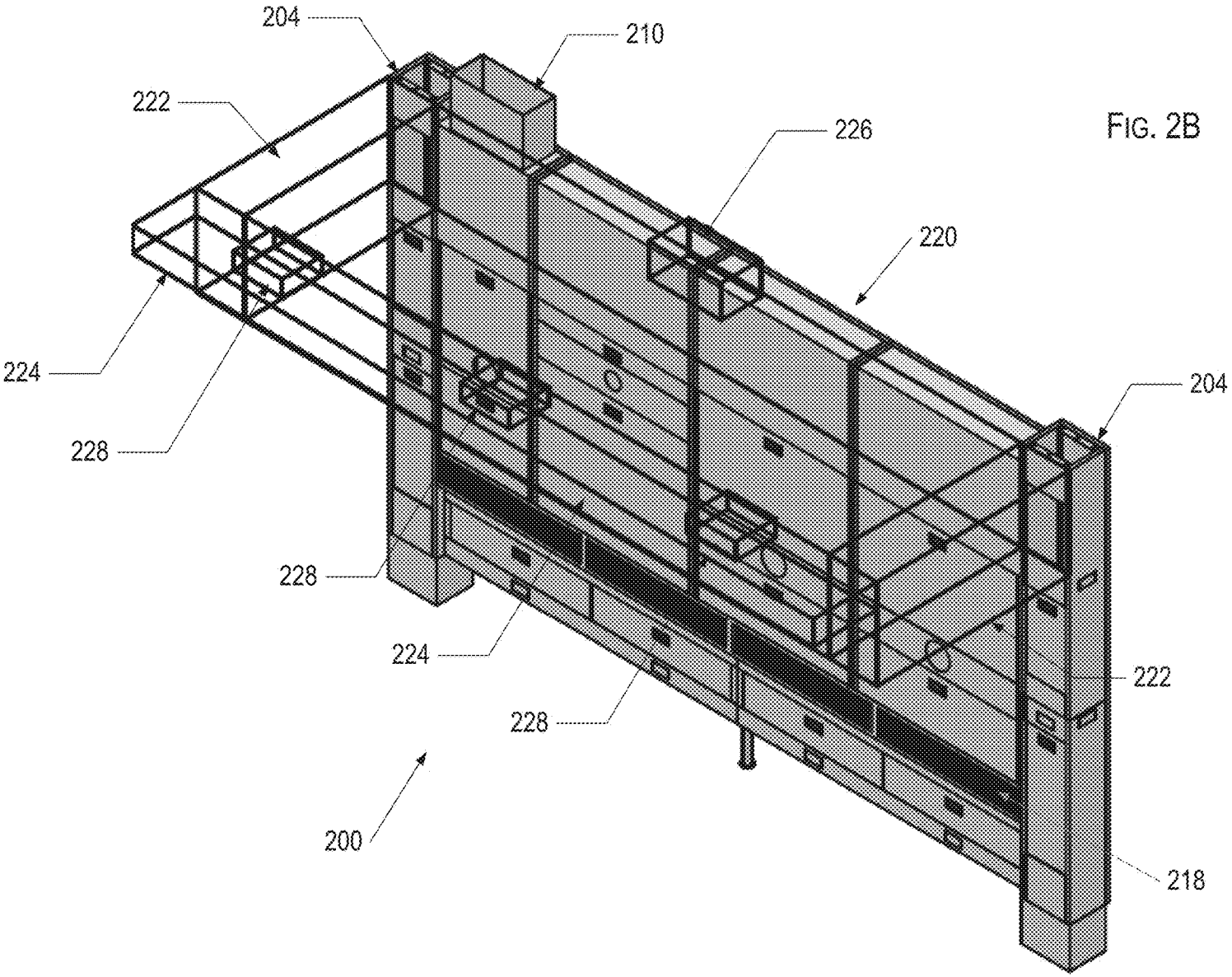
FIG. 2B is a schematic representation of the diversion plenum as shown in FIG. 2A, further showing aspects of a canopy hood, according to aspects of the present disclosure.

FIG. 2B is a schematic representation of the diversion plenum 200 as shown in FIG. 2A, further showing aspects of a canopy hood 220 (alternatively referred to as an exhaust hood) shown in wireframe. The canopy hood 220 can include utility hood cabinets 222, extending from each utility vertical 204, the utility hood cabinets 222 providing side structures for the overall canopy hood 220. The canopy hood 220 can also include a forward plenum 224 (alternatively referred to as a "make-up air", a "supply", and/or a "return" plenum), extending across the length of the overall canopy hood 220. The canopy hood 220 further includes a grease exhaust collar 226 which routes (typically grease laden) cooking emissions out of the canopy hood 220 to an exhaust or outlet dedicated to unclean air, to separate ductwork than used for clean air in and coming from the diversion plenum 200.

The forward plenum 224 of the canopy hood 220 can further include one or more supply air collars 228, where the supply air collars 228 can provide for supply, make-up, or return air to balance the air drawn out of a location by the exhausting of the canopy hood 220. The air from the supply air collars 228 can be tempered air, optionally having been tempered by heat exchange between combustion emissions directed through the diversion plenum 200. The air from the supply collars can also be air drawn in directly from the environment, or from the exterior of a building in which the canopy hood 220 is located.

Thus, it can be appreciated that a plurality of gas appliances having burn chambers can be directly connected to a plenum, where the plenum is connected to an exhaust duct and ventilator, that collects and transports a heated mass of combustion emission to one or more heat recovery devices. The arrangement of access ports on the plenum allows for a wide range of appliance arrangements and configurations connecting to the plenum, on one or more sides of the plenum. The flexible and/or custom construction and arrangement of the kitchen appliances as connected to the diversion plenum allows for easy and efficient connection and disconnection to each other as part of the diversion heat recovery system. In modular aspects of the present disclosure, the kitchen appliances being put in fluid communication with the diversion plenum through adaptor flues allows for disconnection of the kitchen appliances from the diversion plenum without having to cut or break structural components of either the kitchen appliances or the diversion plenum—the primary action to disconnect the kitchen appliances from the diversion plenum is simply uncoupling and taking off the adaptor flues. Thus, the kitchen appliances can be moved, providing for ease in rearranging the kitchen appliances and cleaning behind or underneath the kitchen appliances.

Figure 3:
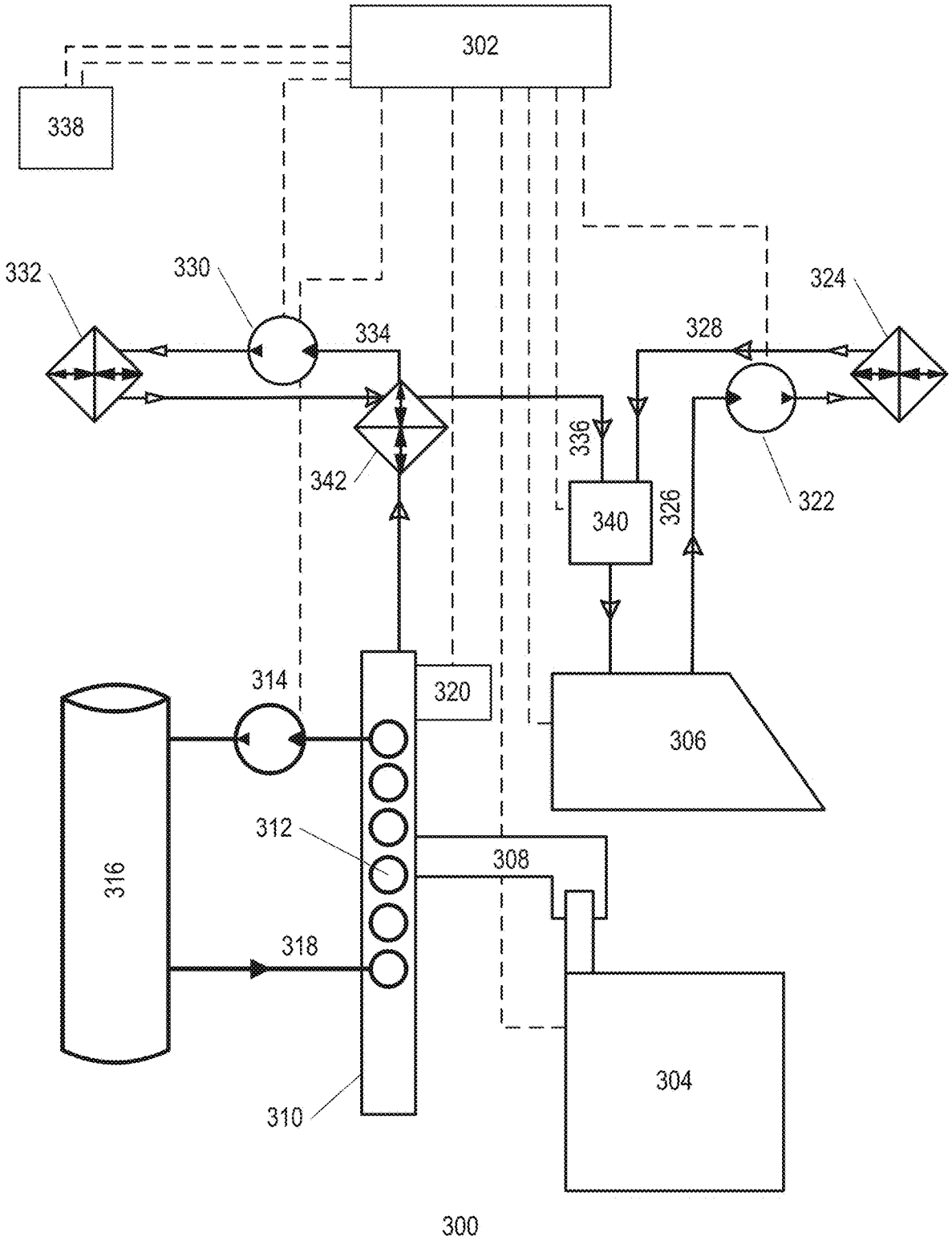
FIG. 3 is a schematic representation of a control system for a heat recovery system, according to aspects of the present disclosure.

FIG. 3 is a schematic representation of a control system 300 for a heat recovery system. Generally, the control system 300 can generally have monitoring equipment that works in coordination with other heating and ventilation equipment. The monitoring equipment can include temperature, optic, volume, current, and/or pressure sensors (or any combination thereof) to monitor the cooking appliance state, and can make exhaust and supply fan adjustments to optimize power use during peak, off peak and idle states. Other types or sensors or combinations thereof can also be used as monitoring equipment. The control system can be further capable of delivering preheated air to a building air conditioning and/or replacement air systems.

A controller 302, which can be a non-transitory computer-readable medium, is in electronic communication with operational components of the heat exchange system 300. The controller 302 can receive data, such as instrument status, temperature measurements, pressure measure, and the like from the apparatus to which the controller is connected. Further, the controller 302 can send and/or relay operational instructions to apparatus having the necessary circuitry for various control functionality. More specifically, the controller 302 can be electrically connected to a kitchen appliance 304 (or a plurality of kitchen appliances), receiving data from the kitchen appliance 304 such as the amount of heat generated by a combustion burner of the kitchen appliance 304 (or an estimate thereof). The controller can further control the amount of combustion generated by the kitchen appliance 304. The controller can be electrically connected to a ventilation hood 306, receiving information such as temperature data or airflow data, and additionally the controller 302 can further activate a fire suppression system within the ventilation hood.

The kitchen appliance 304 can be connected via a flue conduit 308 to a combustion exhaust chamber 310, where the connection is configured such that primarily clean combustion emissions are directed from the kitchen appliance 304 to the combustion exhaust chamber 310. In some embodiments, a fluid heat exchange structure 312 can be mounted within the combustion exhaust chamber 310 and can form a closed fluid loop, with a fluid pump 314 (and associated conduit) leading and moving fluid toward a fluid storage 316, and a fluid return conduit 318 (where the fluid return conduit 318 leads from the fluid storage 316 directing fluid back toward the fluid heat exchange structure 312). The controller 302 can be electronically connected to the fluid pump 314, being capable of sending, for example, fluid pressure data to the controller 302 and further being capable of operating at a speed or rate as instructed by the controller 302. Further, the controller 302 can be electronically connected to sensors 320 coupled to the combustion exhaust chamber 310, where the sensors can be thermal sensors, optic sensors, air volume sensors, air current sensors, air pressure sensors, or a combination thereof. The data received from the sensors 320 can provide the controller 302 with further data that can be used as guidance on how to manage and control other components of the control system 300.

The controller 302 can connect to a combustion emission fan 330 and control the speed and operation of the combustion emission fan 330. The combustion emission fan 330 is configured to draw the emissions from the combustion exhaust chamber 310, which are generally free of any grease, smoke, or particulates, through the combustion emission outlet 334. The combustion emission fan 330 can further direct combustion emissions to a combustion emission heat exchanger 332, where the heat in the combustion emissions can be exchanged with external air, thereby tempering the external air, drawn into a primary tempered air input 336. In some aspects, the tempered air in the primary tempered air input 336 can be routed directly back to the ventilation hood 306 as an air supply provided back into the kitchen. In other aspects, the tempered air in the primary tempered air input 336 can be routed to the HVAC plenum 340, which can then further direct air to the ventilation hood 306 as a make-up or return air supply.

In a further embodiment, an air-based heat exchanger 342 can be located in the flow path of combustion emission outlet 334 and primary tempered air input 336. Heat exchange with clean combustion emissions can be conducted at the air-based heat exchanger 342 to efficiently exchange heat in addition to, or independently of, fluid heat exchange structure 312. Tempering of the air in the primary tempered air input 336 can occur at the air-based heat exchanger 342 independent of the combustion emission heat exchanger 332.

Similarly, the controller 302 can connect to a laden emission fan 322 and control the speed and operation of the laden emission fan 322. The laden emission fan 322 is configured to draw the emissions from the ventilation hood 306 which are relatively dirty, being laden with grease or smoke (optionally, albeit typically, filtered through filtering elements within the ventilation hood 306) through the laden emission outlet 326. The laden emission fan 322 can optionally further direct laden emissions to a laden emission heat exchanger 324, where the heat in the laden emissions can be exchanged with external air, thereby tempering the external air, drawn into a secondary tempered air input 328. The tempered air in the secondary tempered air input 328 can be routed to an HVAC plenum 340, and can optionally be further routed back to the ventilation hood 306 as part of an air supply provided back into the kitchen. The controller 302 can further be electronically connected to the HVAC plenum 340 and sensors therein, and can control the operation of the HVAC plenum 340 to direct airflow and airspeed within the HVAC plenum 340, and optionally to a larger HVAC system.

The controller 302 can further electronically connect to a remote controller interface 338, where the remote controller interface 338 can display output data regarding the heat exchange system, such as the temperature of system element, fluid or gas pressures in the system, speed and load of fans or ventilators in the system, and the like. The remote controller interface 338 can further to receive and relay input instructions to the controller 302 to operate and control the various components of the heat exchange system. In various embodiments, the remote controller interface 338 can receive input from a user, from a dynamic program, or from an automated program, or a combination thereof.

The heat recovery system of the present disclosure provides for a highly efficient, streamlined construction applicable in almost any commercial kitchen, that is unavailable in the field. This unmet need, to readily, efficiently, and economically collect and recover heat from kitchen appliances (and commercial appliances in general) remains an area of the industry where the secondary considerations of cost reduction, both in the kitchen and in the building where the kitchen is located, stemming from repurposing and application of the recovered heat can be leveraged to great effect.

Accordingly, HVAC and heat exchange controllers and control systems as described herein can include a microprocessor can further be a component of a processing device that controls operation of the imaging instrumentation. The processing device can be communicatively coupled to a non-volatile memory device via a bus. The non-volatile memory device may include any type of memory device that retains stored information when powered off. Non-limiting examples of the memory device include electrically erasable programmable read-only memory ("ROM"), flash memory, or any other type of non-volatile memory. In some aspects, at least some of the memory device can include a non-transitory medium or memory device from which the processing device can read instructions. A non-transitory, computer-readable medium can include electronic, optical, magnetic, or other storage devices capable of providing the processing device with computer-readable instructions or other program code. Non-limiting examples of a non-transitory, computer-readable medium include (but are not limited to) magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, Java, Python, Perl, JavaScript, etc.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments, within the spirit of the present invention, will be apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. Many other embodiments are possible without deviating from the spirit and scope of the invention. These other embodiments are intended to be included within the scope of the present invention, which is set forth in the following claims.

What is claimed is:

1. A diversion heat exchange system, comprising:

two appliances that each generate both combustion emissions and cooking emissions, wherein a first appliance of the two appliances comprises a first combustion flue at a first vertical height, and wherein a second appliance of the two appliances comprises a second combustion flue at a second vertical height different than the first vertical height;

a hood structure arranged above the two appliances configured to collect and ventilate the cooking emissions; and a diversion plenum comprising:

a plenum configured to receive the combustion emissions from the first and second combustion flues of the two appliances;

a fluid heat recovery structure, mounted within the plenum, wherein the fluid heat recovery structure comprises a set of fluid exchange coils configured to flow a thermal fluid through the fluid exchange coils, a fluid heat exchange inlet and a fluid heat exchange outlet, wherein the fluid heat exchange inlet and the fluid heat exchange outlet are in fluid communication with the fluid exchange coils and both are configured to flow the thermal fluid therethrough;

a deflection rudder positioned within the plenum, wherein the deflection rudder is configured to direct the combustion emissions from the first and second combustion flues of the two appliances downwardly so that the combustion emissions pass vertically up through the fluid heat recovery structure; and an exhaust duct arranged above the fluid heat recovery structure and configured to direct away the combustion emissions after the combustion emission passes vertically up through the fluid heat recovery structure.

2. The system of claim 1, wherein the hood structure is a Type I hood or a Type II hood further connected to an exhaust fan configured to exhaust the cooking emissions.

3. The system of claim 1, further comprising:

an air tempering heat exchanger, configured to transfer heat from the combustion emissions into air drawn from an atmosphere to thereby generate tempered air; and a supply duct, in fluid communication with the air tempering heat exchanger, configured to deliver the tempered air to the appliances.

4. The system of claim 3, wherein the air tempering heat exchanger is along the exhaust duct.

5. The system of claim 1, further comprising a ventilator arranged to draw air out of the diversion plenum.

6. The system of claim 1, wherein a portion of the fluid exchange coils is positioned vertically below the first and second combustion flues, and wherein the deflection rudder directs the combustion emissions to a buffer region of the plenum located below the fluid exchange coils.

* * * * *